US011672319B2

(12) United States Patent
Chien et al.

(10) Patent No.: US 11,672,319 B2
(45) Date of Patent: Jun. 13, 2023

(54) ENVIRONMENT-FRIENDLY PRESS BOTTLE INTEGRATED WITH A BELLOWS SPRING AND EQUIPPED WITH AN OUTER SHELL

(71) Applicant: RIFE PLUS (SHANGHAI) CO., LTD, Shanghai (CN)

(72) Inventors: Chia-Hung Chien, Shanghai (CN); Chiu-Huo Chen, Miaoli County (TW)

(73) Assignee: RIFE PLUS (SHANGHAI) CO., LTD, Shanghai (CN)

( * ) Notice: Subject to any disclaimer, the term of this patent is extended or adjusted under 35 U.S.C. 154(b) by 0 days.

(21) Appl. No.: 17/523,965

(22) Filed: Nov. 11, 2021

(65) Prior Publication Data

US 2023/0042231 A1 Feb. 9, 2023

(30) Foreign Application Priority Data

Aug. 9, 2021 (CN) ..... 202110910552.6

(51) Int. Cl.
*A45D 34/04* (2006.01)
*B65D 83/00* (2006.01)

(52) U.S. Cl.
CPC ..... *A45D 34/04* (2013.01); *B65D 83/0038* (2013.01); *A45D 2200/054* (2013.01)

(58) Field of Classification Search
CPC ..... A45D 34/04; A45D 2200/054; B65D 83/0038

(Continued)

(56) References Cited

U.S. PATENT DOCUMENTS 2,129,119 A * 9/1938 Davis ..... B65D 83/0055 222/105
3,575,318 A * 4/1971 Kunz ..... F41B 9/0065 222/326

(Continued)

FOREIGN PATENT DOCUMENTS

WO WO-2009033053 A1 * 3/2009 ..... A61F 9/0008
WO WO-2009073482 A1 * 6/2009 ..... A61F 9/0008

*Primary Examiner* — Paul R Durand
*Assistant Examiner* — Michael J. Melaragno
(74) *Attorney, Agent, or Firm* — Cantor Colburn LLP

(57) ABSTRACT

The present disclosure provides an environment-friendly press bottle integrated with a bellows spring and equipped with an outer shell, comprising: an inner bottle of which the lower end is integrated with the upper end of a bellows spring; the lower end of the bellows spring is a closed structure; the upper end of the inner bottle is necked to form a connector; the aperture in the middle of the connector is fitted with a nozzle; a step that fits onto the connector and limits its position is disposed on the central outer side of the nozzle; an annular flange that snaps into the corresponding position on the inner surface of the connector is disposed on the outer side of the lower end of the nozzle, and external threads are provided on the outer surface of the connector; a cover lid is provided with internal threads and is connected to the external threads of the connector; the inner bottle is tightly nested in the outer bottle that serves as an outer shell. The present disclosure integrates the body of the inner bottle with the bellows spring, which significantly simplifies the structure, increases effective volume, saves material, and guarantees recycle of all parts of the device when the content is exhausted. The device is particularly suitable for the packaging of cosmetic products in lotion form.

8 Claims, 4 Drawing Sheets

(58) Field of Classification Search
USPC ..... 222/214
See application file for complete search history.

(56) References Cited

U.S. PATENT DOCUMENTS 3,873,003 A * 3/1975 Seiferth ..... B65D 83/0027 222/105
4,067,499 A * 1/1978 Cohen ..... A61M 11/007 239/323
4,296,071 A * 10/1981 Weiss ..... B01L 3/021 73/864.18
4,544,073 A * 10/1985 Willis ..... B65D 51/18 215/277
4,634,023 A * 1/1987 Tanaka ..... B65D 47/18 222/105
5,094,363 A * 3/1992 Monahan ..... A45F 3/20 222/523
5,186,563 A * 2/1993 Gebhard ..... B65D 47/42 401/164
5,240,152 A * 8/1993 Scholz ..... B65D 83/0011 222/326
5,261,571 A * 11/1993 Goncalves ..... G01F 11/08 222/541.6
5,282,549 A * 2/1994 Scholz ..... B65D 83/75 222/326
5,353,961 A * 10/1994 Debush ..... B65D 25/08 222/207
6,336,571 B1 * 1/2002 Chibret ..... A61F 9/0008 222/189.09
7,165,701 B2 * 1/2007 Hirota ..... B65D 47/18 222/421
7,296,945 B1 * 11/2007 Byun ..... B05B 11/307 401/175
7,306,129 B2 * 12/2007 Swiss ..... B65D 47/205 222/326
7,314,329 B1 * 1/2008 Byun ..... B05B 11/3094 401/270
7,513,396 B2 * 4/2009 Pardes ..... B65D 47/205 222/326
7,874,467 B2 * 1/2011 Pardes ..... A61M 15/08 222/326
7,997,460 B2 * 8/2011 Pardes ..... A61M 11/008 222/326
8,123,063 B2 * 2/2012 Kanda ..... F16N 19/00 220/666
8,231,019 B2 * 7/2012 Battegazzore ..... B65D 41/0492 215/253
8,302,823 B2 * 11/2012 Lim ..... B65D 35/46 222/495
9,266,381 B2 * 2/2016 Yen ..... B43L 19/0018
9,452,869 B2 * 9/2016 Katayama ..... B05B 11/303
10,328,451 B2 * 6/2019 Kang ..... B43M 11/06
2005/0173456 A1 * 8/2005 Backes ..... B65D 47/2018 222/212
2006/0037968 A1 * 2/2006 Brenner ..... B65D 83/0055 222/105
2006/0037972 A1 * 2/2006 Leiner ..... A61C 5/62 222/212
2008/0197150 A1 * 8/2008 Beltrame ..... B01L 3/0272 222/420
2010/0278698 A1 * 11/2010 Tajima ..... G01N 35/1065 422/522
2011/0297703 A1 * 12/2011 Wilson ..... B65D 47/18 222/571
2012/0279995 A1 * 11/2012 Bugenske ..... B65D 83/0055 222/215
2015/0202913 A1 * 7/2015 Yen ..... B43L 19/0018 401/258
2015/0266658 A1 * 9/2015 Tajima ..... G01N 35/1065 222/1
2016/0045929 A1 * 2/2016 Skidmore ..... B05C 17/00576 427/140
2022/0015523 A1 * 1/2022 Ohn ..... B05B 11/061

* cited by examiner

ENVIRONMENT-FRIENDLY PRESS BOTTLE INTEGRATED WITH A BELLOWS SPRING AND EQUIPPED WITH AN OUTER SHELL

CROSS REFERENCE TO RELATED APPLICATIONS

The present application claims the benefit of China Patent Application No. 202110910552.6 filed Aug. 9, 2021, which is hereby incorporated by reference in its entirety.

TECHNICAL FIELD

This disclosure relates to cosmetic packaging, and more particularly to an environment-friendly press bottle.

BACKGROUND

The skin is a crucial component of the human body that prevents physical or chemical invasion from the outside. Today, men and women make use of a variety of cosmetics and skin care products for protection and beauty purposes, some of the most common products being all sorts of creams and lotions.

Lotion has become more and more popular as society progresses. The application of lotion makes the skin glow and effectively moisturizes and protects the skin. It is an essential cosmetic product particularly for women as it helps demonstrate feminine beauty.

Current technology usually consists of filling lotion into a bottle and pressing during use. However, such bottles generally employ an independent metal spring as the return spring, which requires additional supporting structures, takes up space, and has little effective volume. Further, it has a complex structure, is troublesome and time consuming to manufacture, high in cost, and difficult to recycle due to the use of various different materials.

BRIEF SUMMARY

The present disclosure aims to solve the problems faced by current press bottles used for packaging lotion-type cosmetic products, namely, the employment of separate return springs, complex structure, difficult recycling of waste materials, high size-to-effective-volume ratio, and high manufacturing cost. In replacement, the present disclosure provides an environment-friendly press bottle for filling cosmetic products with a simplified structure, increased effective volume, and less required materials, while simultaneously optimizing the structural parameters of the key functional bellows structure and allows for easy and convenient recycling.

The purpose of the present disclosure is achieved with the following technical means:

An environment-friendly press bottle integrated with a bellows spring and equipped with an outer shell, characterized in that it comprises an inner bottle of which the lower end is integrated with the upper end of a bellows spring; the lower end of the bellows spring is a closed structure; the upper end of the inner bottle is necked to form a connector; the aperture in the middle of the connector is fitted with a nozzle; a step that fits onto the connector and limits its position is disposed on the central outer side of the nozzle; an annular flange that snaps into the corresponding position on the inner surface of the connector is disposed on the outer side of the lower end of the nozzle, and external threads are provided on the outer surface of the connector; a cover lid is provided with internal threads and is connected to the external threads of the connector; the inner bottle is tightly nested in the outer bottle that serves as an outer shell; a shoulder is disposed on the outer side of the upper end of the inner bottle; the shoulder snap-fits into the annular upper groove disposed on the inner side of the upper end of the outer bottle; the lower end of the bellows spring is pressed against a pressing lid; the pressing lid slides along with the outer bottle; all parts of this device are manufactured with the same nontoxic engineering plastic.

Preferably, the longitudinal section of the bellows spring presents a trapezoid-wave-like structure with a rounded wave crest and wave trough. The wall of the bellows spring is 0.2-0.40 mm in thickness. The trapezoid-wave-like structure has a crest angle A that is 53-57° and a trough angle B that is 27-32°.

Preferably, the cover lid is formed with an outer lid and an inner lid that is fixed within, wherein the internal threads are provided at the central area of the inner lid; an annular rib is disposed on the outer side of the front end of the inner lid, and an annular groove is disposed on the inner side of the front end of the outer lid so that the annular rib may fit into the annular groove and axially secure the inner lid and the outer lid; several fins are evenly disposed on the rear end of the inner lid with spacers set in between; several axial ribs are correspondingly distributed on the rear end of the outer lid; the ribs and spacers clamp with each other so as to circumferentially secure the inner lid and the outer lid.

Preferably, the section of the pressing lid presents a U-shaped structure, wherein a bead disposed on the inner side of the pressing lid fits into the annular lower groove disposed on the outer side of the lower end of the bellows spring.

Preferably, a curved recess is located at the lower edge of the outer bottle for ease of operating the pressing lid.

Preferably, a gap of ample space is set between the outside diameter of the bellows spring and the inside diameter of the outer bottle, and the gap is wider than the increased size of the pressed and contorted bellows spring.

Preferably, a spherical dent is located at the rear end surface of the pressing lid.

Preferably, a recessed shoulder is disposed on the lower end of the annular lower groove of the bellows spring, and the bead of the pressing lid and the recessed shoulder form an interference fit; the amount of interference is 0.20-0.40 mm.

Preferably, the nontoxic engineering plastic is PP material, namely, polypropylene.

The present disclosure achieves the following beneficial effects:

1. The present disclosure integrates the body of the inner bottle with the bellows spring. The bellows spring serves as both a part of the bottle that stores the cosmetic product and the return spring of the device. This significantly simplifies the structure, allows for increased effective volume, saves material, and guarantees recycle of all parts of the device when the content is exhausted, which contributes to the goal of environmental protection. The device is particularly suitable for the packaging of cosmetic products in lotion form.
2. The key functional bellows spring is parametrically optimized to achieve coordination between connection, pressing dynamics, and structural strength;
3. As the body of the inner bottle is integrated with the bellows spring, the process of manufacture and assembly of the present device is simplified, less time-consuming, and reduced in cost;

4. As all parts of the device are manufactured with PP material, contamination from other materials may be avoided. The PP material is provided at a food hygiene grade and guarantees a certain level of hygiene;
5. Metal parts such as metal springs are eliminated, avoiding potential contamination of metal materials;
6. The used device may be recycled in its entirety without separating each part, fulfilling environmental protection requirements.

DETAILED DESCRIPTION

The following descriptions are provided along with figures to describe in detail the embodiments of the present disclosure: The examples are implemented based on the technical means of the present disclosure, and the detailed implementation and specific operation processes are provided in full detail below. However, the examples are not intended to limit the scope of the present disclosure.

Example 1

Figure 1:
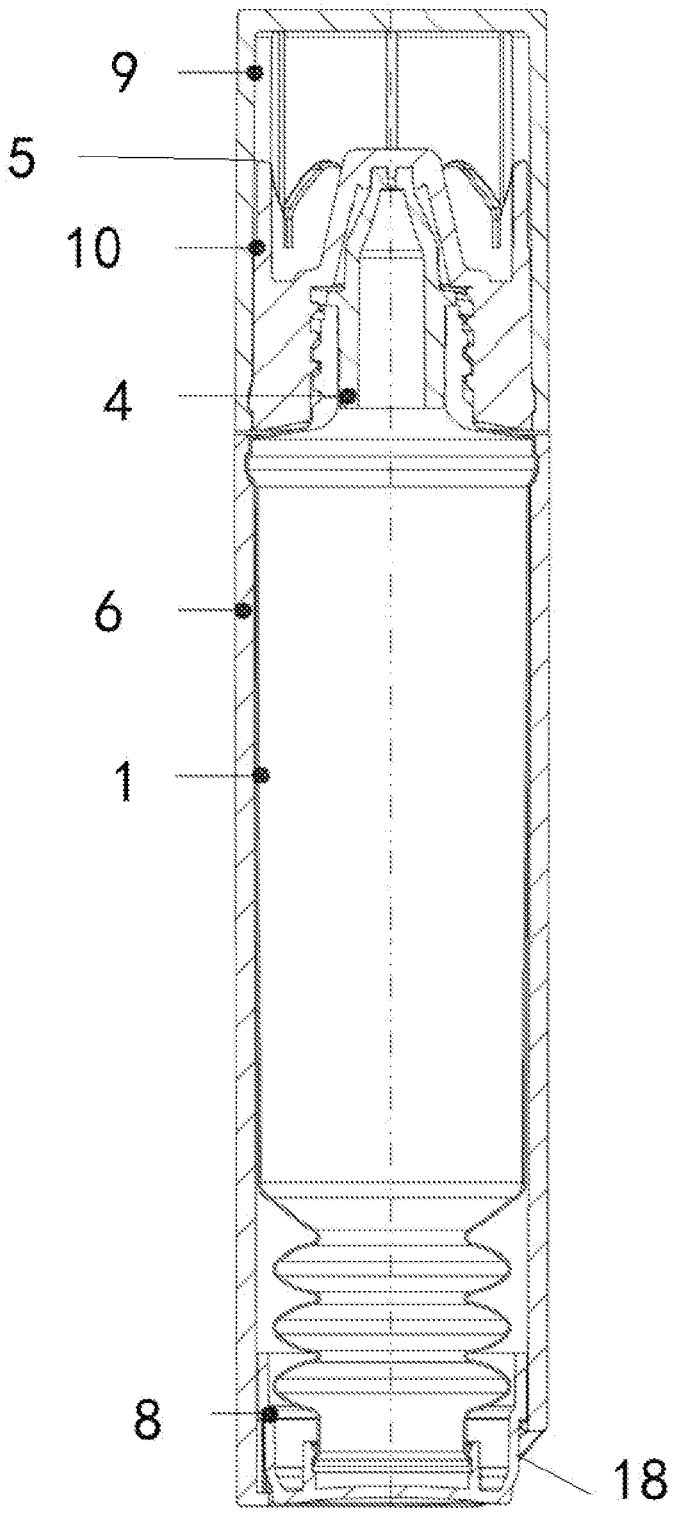
FIG. 1 is a schematic diagram of an embodiment of the present disclosure.
Figure 2:
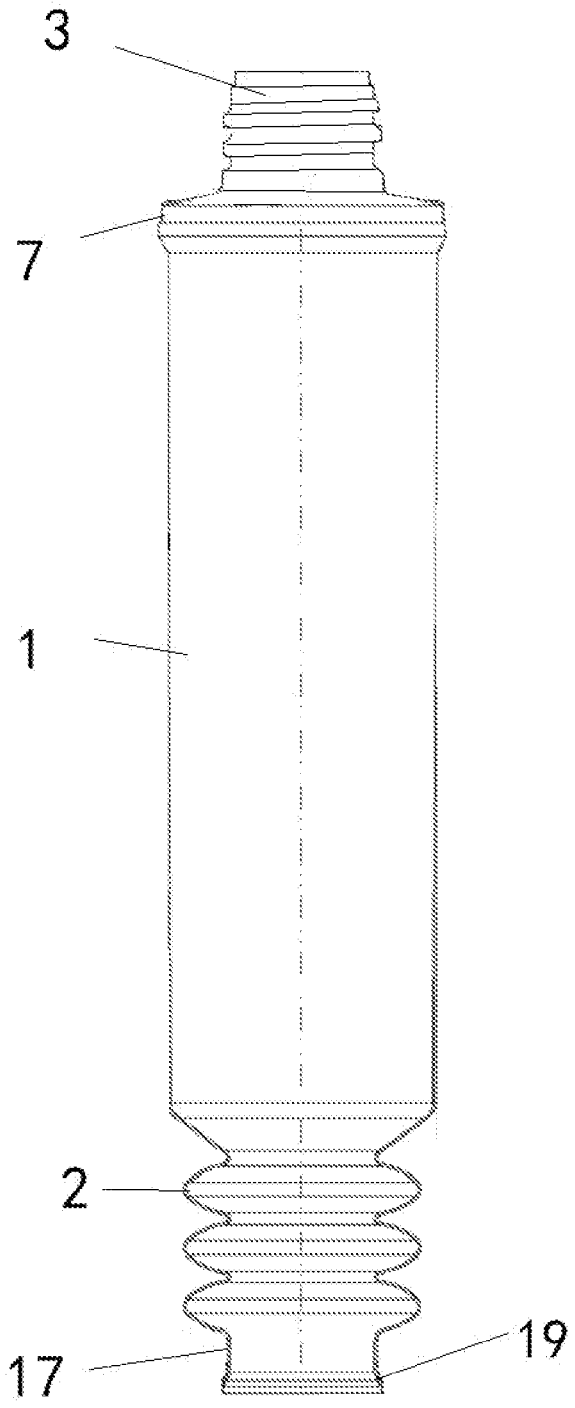
FIG. 2 is a schematic diagram depicting the integration of the inner bottle with the bellows spring.

With reference to FIG. 1 and FIG. 2, an environment-friendly press bottle integrated with a bellows spring and equipped with an outer shell is provided, which comprises an inner bottle 1; the lower end of the inner bottle 1 is integrated with the upper end of a bellows spring 2; the bellows spring 2 is a spring in the shape of bellows; the upper end of the bellows spring 2 is integrated with the inner bottle 1; the lower end of the bellows spring 2 is a flat-bottomed closed structure; the inner cavity of the bellows spring 2 forms a part of the inner bottle 1.

Figure 3:
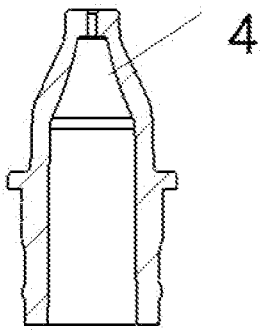
FIG. 3 is a schematic diagram of the nozzle.

The upper end of the inner bottle 1 is necked to form a connector 3; an aperture is provided in the middle of the connector 3 and is fitted with a nozzle 4; a step that fits onto the connector and limits its position is disposed on the central outer side of the nozzle 4; an annular flange that snaps into the corresponding position on the inner surface of the connector 3 is disposed on the outer side of the lower end of the nozzle, with reference to FIG. 3.

External threads are provided on the outer surface of the connector 3; a cover lid 5 is provided with internal threads and is connected to the external threads of the connector 3; the inner bottle 1 is tightly nested in the outer bottle 6 that serves as an outer shell; the outer bottle has a thick wall that is thicker than that of the inner bottle, which guarantees a certain level of rigidity that prevents the inner bottle from contortion due to external forces from the sides. A shoulder 7 is disposed on the outer side of the upper end of the inner bottle 1; the shoulder 7 snap-fits into the annular upper groove disposed on the inner side of the upper end of the outer bottle 6; the lower end of the bellows spring 2 is pressed against a pressing lid 8; the pressing lid 8 slides along with the outer bottle 6; the lower end of the bellows spring 2 is a flat-bottomed structure so that it may press against the pressing lid 8.

Figure 4:
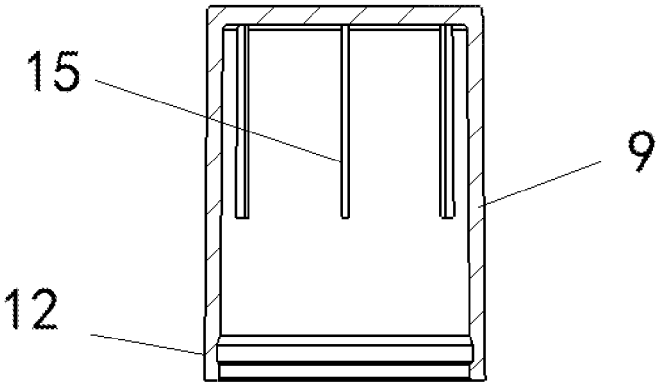
FIG. 4 is a schematic diagram of the outer lid.
Figure 5:
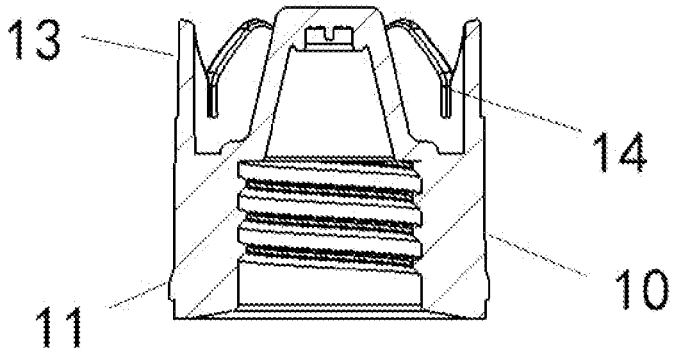
FIG. 5 is a schematic diagram of the inner lid.

The cover lid 5 is formed with an outer lid 9 and an inner lid 10 that is fixed within, with reference to FIG. 4 and FIG. 5. The internal threads are provided at the central area of the inner lid 10; an annular rib 11 is disposed on the outer side of the front end of the inner lid 10, and an annular groove 12 is disposed on the inner side of the front end of the outer lid 9 so that the annular rib 11 may fit into the annular groove 12 and axially secure the inner lid 10 and the outer lid 9; six fins 13 are evenly disposed on the rear end of the inner lid 10, and the fins 13 have a certain level of elasticity; spacers 14 are located between adjacent fins 13; six axial ribs 15 are correspondingly disposed on the rear end of the outer lid 9; the ribs 15 are inserted into the spacers 14, and the ribs and spacers clamp with each other so as to circumferentially secure the inner lid 10 and outer lid 9.

Figure 6:
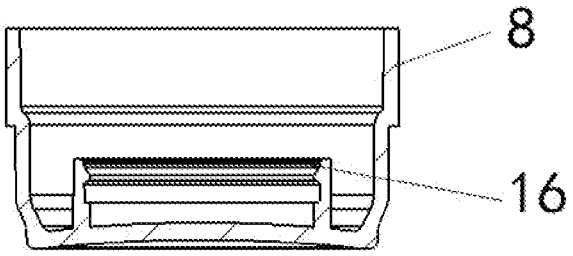
FIG. 6 is a schematic diagram of the pressing lid.

The section of the pressing lid 8 presents a U-shaped structure; a bead 16 disposed on the inner side of the pressing lid 8 fits into the annular lower groove 17 disposed on the outer side of the lower end of the bellows spring 2. A recessed shoulder 19 is disposed on the lower end of the annular lower groove 17 of the bellows spring 2; the recessed shoulder 19 acts as a barrier that prevents easy passage of the bead 16 of the pressing lid 8; the bead 16 of the pressing lid 8 and the recessed shoulder 19 form an interference fit, and the amount of interference is 0.25-0.30 mm. An appropriate amount of force must be exerted on the bead 16 of the pressing lid 8 so that it may enter or exit the recessed shoulder 19. The bead 16 may slide with the gap of the annular lower groove 17 after connecting with the inner bottle 1 through the recessed shoulder 19. The optimized pressing force is 45N. The pressing force may not be too strong or too weak, as a strong force results in damaged parts, while a weak force results in the parts' tendency to fall off, with reference to FIG. 2 and FIG. 6.

A curved recess 18 is located at the lower edge of the outer bottle 6 for ease of operating the pressing lid 8.

Figure 7:
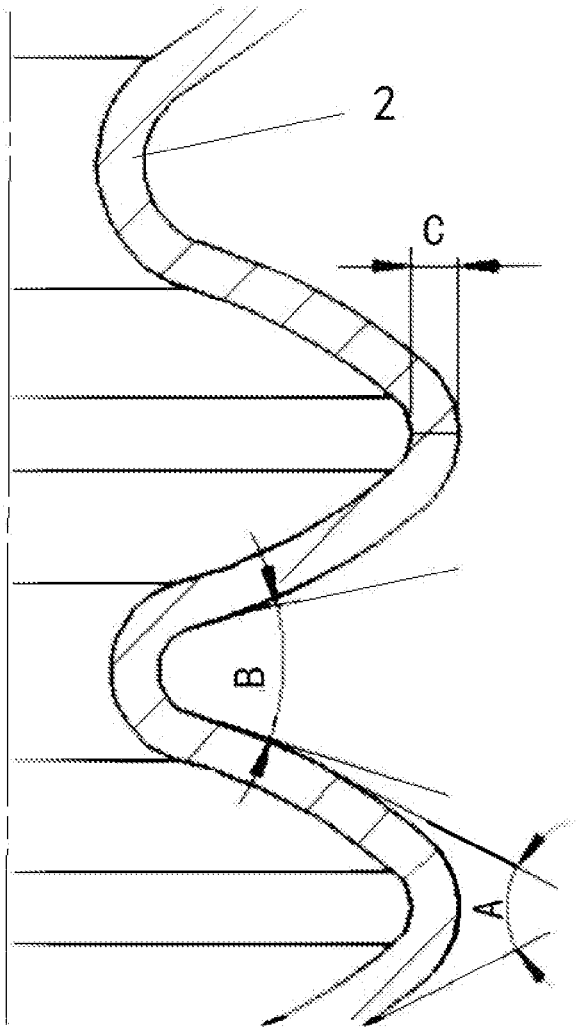
FIG. 7 is a schematic diagram of the trapezoid-wave-like structure of the bellows spring 2.

The longitudinal section of the bellows spring 2 presents a trapezoid-wave-like structure with a rounded wave crest and wave trough. The wall of the bellows spring is 0.20-0.40 mm in thickness (C), most preferably 0.30 mm. The trapezoid-wave-like structure has a crest angle A that is 53-57°, most preferably 54.7°; the trapezoid-wave-like structure has a trough angle B that is 27-32°, most preferably 29.7°. The present disclosure parametrically optimizes the key functional bellows spring to achieve coordination of connection, pressing dynamics, rebound force, and structural strength; with reference to FIG. 7.

The wall of the bellows spring (C) may not be too thick or too thin, as a thin wall makes the press softer and results in insufficient rebound and elastic fatigue, while a thick wall makes the press more rigid and results in higher resistance and discomfort in use.

A gap of ample space is set between the outside diameter of the bellows spring 2 and the inside diameter of the outer bottle 6, and the gap is wider than the increased size of the pressed and contorted bellows spring 2, which prevents the bellows spring 2 from being resisted due to increased outside diameter during press.

All parts of the present device are manufactured with the same nontoxic engineering plastic, PP, namely, polypropylene, which is a food-grade nontoxic engineering plastic. As all parts are manufactured with the same material, the device can be recycled in its entirety without separating each part, fulfilling environmental protection requirements.

Example 2

A spherical dent is located at the back end of the pressing lid so that the pressing is made easier. The remaining structures are identical to Example 1.

The above illustrates the essence and main features of the present disclosure. A person skilled in the art shall appreciate that the present disclosure is not limited to the embodiments, and the embodiments and descriptions have been presented only for the purpose of illustrating the essence of the present disclosure. Numerous changes and modifications to the disclosed embodiments can be made in accordance with the disclosure herein without departing from the spirit or scope of the disclosure, and these changes and modifications will fall in the scope of protection. The present disclosure requests that its scope of protection be defined by its claims and their equivalents.

What is claimed is:

1. An environment-friendly press bottle integrated with a bellows spring and equipped with an outer shell, comprising: an inner bottle of which the lower end is integrated with the upper end of a bellows spring; the lower end of the bellows spring is a closed structure; the upper end of the inner bottle is necked to form a connector; the aperture in the middle of the connector is fitted with a nozzle; a step that fits onto the connector and limits its position is disposed on the central outer side of the nozzle; an annular flange that snaps into the corresponding position on the inner surface of the connector is disposed on the outer side of the lower end of the nozzle, and external threads are provided on the outer surface of the connector; a cover lid is provided with internal threads and is connected to the external threads of the connector; the inner bottle is in an outer bottle that serves as an outer shell; a shoulder is disposed on the outer side of the upper end of the inner bottle; the shoulder snap-fits into an annular upper groove disposed on the inner side of the upper end of the outer bottle; the lower end of the bellows spring is pressed against a pressing lid; the pressing lid slides along within the outer bottle; all parts of this device are manufactured with a nontoxic engineering plastic;

wherein the cover lid is formed with an outer lid and an inner lid that is fixed within;

the internal threads are provided at the central area of the inner lid; an annular rib is disposed on the outer side of the front end of the inner lid, and an annular groove is disposed on the inner side of the front end of the outer lid so that the annular rib may fit into the annular groove and axially secure the inner lid and the outer lid; several fins are evenly disposed on the rear end of the inner lid with spacers set in between; several axial ribs are correspondingly distributed on the rear end of the outer lid; the ribs and spacers clamp with each other so as to circumferentially secure the inner lid and the outer lid.

2. The environment-friendly press bottle integrated with a bellows spring and equipped with an outer shell of claim 1, wherein the longitudinal section of the bellows spring presents a trapezoid-wave-like structure with a rounded wave crest and wave trough; the wall of the bellows spring C is 0.20-0.40 mm in thickness; the trapezoid-wave-like structure has a crest angle A that is 53-57° and a trough angle B that is 27-32°.

3. The environment-friendly press bottle integrated with a bellows spring and equipped with an outer shell of claim 1, wherein the section of the pressing lid presents a U-shaped structure; a bead disposed on the inner side of the pressing lid fits into the annular lower groove disposed on the outer side of the lower end of the bellows spring.

4. The environment-friendly press bottle integrated with a bellows spring and equipped with an outer shell of claim 3, wherein a curved recess is located at the lower edge of the outer bottle for ease of operating the pressing lid.

5. The environment-friendly press bottle integrated with a bellows spring and equipped with an outer shell of claim 4, wherein a gap of ample space is set between the outside diameter of the bellows spring and the inside diameter of the outer bottle, and the gap is wider than the increased size of the pressed and contorted bellows spring.

6. The environment-friendly press bottle integrated with a bellows spring and equipped with an outer shell of claim 5, wherein a spherical dent is located at the rear end surface of the pressing lid.

7. The environment-friendly press bottle integrated with a bellows spring and equipped with an outer shell of claim 6, wherein a recessed shoulder is disposed on the lower end of the annular lower groove of the bellows spring, and the bead of the pressing lid and the recessed shoulder form an interference fit; the amount of interference is 0.25-0.30 mm.

8. The environment-friendly press bottle integrated with a bellows spring and equipped with an outer shell of claim 5, wherein the nontoxic engineering plastic is PP material.

* * * * *